US007734158B2

(12) United States Patent
Kondo et al.

(10) Patent No.: US 7,734,158 B2
(45) Date of Patent: Jun. 8, 2010

(54) STEAM GENERATOR

(75) Inventors: Yoshiyuki Kondo, Takasago (JP); Jiro Kasahara, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 251 days.

(21) Appl. No.: 11/920,079

(22) PCT Filed: May 18, 2006

(86) PCT No.: PCT/JP2006/309951

§ 371 (c)(1),
(2), (4) Date: Nov. 8, 2007

(87) PCT Pub. No.: WO2006/123746

PCT Pub. Date: Nov. 23, 2006

(65) Prior Publication Data

US 2009/0022484 A1 Jan. 22, 2009

(30) Foreign Application Priority Data

May 20, 2005 (JP) ..... 2005-147916

(51) Int. Cl.
*H05B 3/60* (2006.01)

(52) U.S. Cl. ..... 392/325; 392/324

(58) Field of Classification Search ..... None
See application file for complete search history.

(56) References Cited

U.S. PATENT DOCUMENTS 1,488,531 A * 4/1924 Cruse ..... 122/114
1,610,751 A * 12/1926 Dantsizen ..... 392/312
3,216,182 A * 11/1965 Cochran et al. ..... 55/336
3,242,313 A * 3/1966 Lamphier ..... 392/325
3,720,046 A * 3/1973 Moen ..... 55/414
3,735,569 A * 5/1973 Micheller et al. ..... 55/348
4,092,519 A * 5/1978 Eaton-Williams ..... 392/325
4,394,561 A * 7/1983 Zerbel ..... 392/329
4,399,349 A * 8/1983 Deming et al. ..... 392/403
4,730,098 A * 3/1988 Cave ..... 392/314

(Continued)

FOREIGN PATENT DOCUMENTS

CN 2499130 Y 7/2002

(Continued)

OTHER PUBLICATIONS

International Search Report mailed Aug. 22, 2006 for International Application PCT/JP2006/309951.
Chinese Office Action dated Oct. 30, 2009 in Chinese patent Application No. 200680017443.5 (with translation).

*Primary Examiner*—Thor S Campbell
(74) *Attorney, Agent, or Firm*—Wenderoth, Lind & Ponack, L.L.P.

(57) ABSTRACT

A steam generator includes a tank having an inlet in a lower part for feeding a fluid, and an outlet in an upper part for discharging a vapor-liquid two phase flow. A heating unit heats the fluid in the tank thereby producing the vapor-liquid two phase flow. A porous cylindrical member projects from the outlet into an inside of the tank and functions as a rectifying unit that homogenizes vapor-liquid distribution in the vapor-liquid two phase flow before the vapor-liquid two phase flow is discharged from the outlet.

6 Claims, 8 Drawing Sheets

U.S. PATENT DOCUMENTS 4,736,713 A * 4/1988 Roarty ..... 122/32
5,075,074 A * 12/1991 Gluntz ..... 376/371
5,283,809 A * 2/1994 Challberg et al. ..... 376/260
5,321,731 A * 6/1994 Oosterkamp ..... 376/371
5,896,864 A * 4/1999 Boyle et al. ..... 132/228
5,949,958 A * 9/1999 Naperkowski et al. ..... 392/399
5,963,611 A * 10/1999 Narabayashi et al. ..... 376/371
6,072,937 A * 6/2000 Benade et al. ..... 392/336
6,647,204 B1 * 11/2003 Hutchinson ..... 392/491
2005/0249485 A1 * 11/2005 Evans ..... 392/447

FOREIGN PATENT DOCUMENTS

| | | |
|---|---|---|
| JP | 57-25819 | 2/1982 |
| JP | 62-131101 | 6/1987 |
| JP | 08-285204 | 11/1996 |
| JP | 10-221480 | 8/1998 |
| JP | 2002-333288 | 11/2002 |
| JP | 2005-326335 | 11/2005 |

* cited by examiner

STEAM GENERATOR

BACKGROUND OF THE INVENTION

I. Technical Field

The present invention relates to a steam generator for a boiler or a nuclear reactor, generates a vapor by heating a fluid, produces and discharges a vapor-liquid two phase flow of the fluid and the vapor.

II. Description of Related Art

Steam generators are used in boilers or nuclear reactors for generating a vapor from a fluid. In such a steam generator, a fluid is introduced into a tank, the fluid in the tank is then heated with a heater and/or a heat exchanger tube to generate vapor (gas bubbles) in the fluid, and the fluid containing the gas bubbles, i.e., a vapor-liquid two phase flow is then discharged to the outside. After that, the vapor-liquid two phase flow is separated into the vapor and the fluid with a vapor-liquid separator as required, and then used.

A boiler provided with such a steam generator is disclosed in Japanese Patent Application Laid-open H8-285204 (JP '204) mentioned below. The boiler described in (JP '204) is configured as follows. That is, a feed pump feeds a fluid into a steam drum; a circulating pump feeds the fed fluid in the steam drum to the steam generator; the steam generator produces a vapor-liquid two phase flow of heated water by heating the fluid; the vapor-liquid two phase flow of heated water is returned to the steam drum; the vapor-liquid two phase flow of heating is separated into a vapor and a hot liquid in the steam drum; and the steam is supplied to a load of various kinds of steam use.

SUMMARY OF THE INVENTION

In the conventional boiler described above, the vapor-liquid two phase flow of the heated water is produced by heating a fluid in the steam generator, and then the vapor-liquid two phase flow of the heated water is returned into the steam drum via a pipe. In this configuration, when the vapor-liquid two phase flow of the heated water in the steam generator is discharged to the pipe, the cross-sectional area of the pipe gets suddenly reduced, so that there is a problem that the vapor-liquid two phase flow is contracted and the flow is disturbed. In other words, when a fluid is heated in the steam generator, bubbles (steam) are generated and the fluid is turned into a vapor-liquid two phase flow, and then the fluid containing the bubbles inflows to the pipe; and when inflowing into the pipe, the amount of the bubbles in the fluid fluctuates, and this generates oscillations, and causes a flow of the vapor-liquid two phase flow to be disturbed. As a result, silence cannot be secured due to the oscillations in the vapor-liquid two phase flow. Moreover, if fluctuations in the vapor-liquid two phase flow occur in the pipe, controlling of a discharge amount turns difficult, so that the efficiency of the whole system drops.

The present invention aims to solve the problem described above, and an object of the present invention is to provide a steam generator that can achieve highly-precise control of a discharge flow by homogenizing a flow of the vapor-liquid two phase flow and suppressing fluctuations in the flow.

To achieve the above object, a steam generator according to the present invention includes a tank having an inlet in a lower part for feeding a fluid, and an outlet in an upper part for discharging a vapor-liquid two phase flow; a heating unit that produces a vapor-liquid two phase flow by heating fluid fed into the tank; and a rectifying unit that homogenizes a vapor-liquid distribution in the vapor-liquid two phase flow in the tank.

In the steam generator, the rectifying unit may include a porous cylindrical member that projects from the outlet into an inside of the tank.

In the steam generator, the rectifying unit may include an orifice that is arranged inside the outlet.

In the steam generator, the rectifying unit may include a porous rectification plate that is arranged in an upper part of the tank.

In the steam generator, the rectifying unit may include a plurality of balls sandwiched between a pair of fixing plates arranged in an upper part of the tank.

In the steam generator, the rectifying unit may include a first rectifying unit provided in an upper part of the tank, and a second rectifying unit may be provided to the outlet.

In the steam generator, the first rectifying unit may include an orifice, and the second rectifying unit may include any one of a porous cylindrical member that projects from the outlet into an inside of the tank, a porous rectification plate, and a plurality of balls sandwiched between a pair of fixing plates.

In the steam generator, the first rectifying unit may include a porous cylindrical member that projects from the outlet into an inside of the tank, the second rectifying unit may include a porous rectification member, and pores of the second rectifying unit have smaller diameters than pores of the first rectifying unit.

In the steam generator, the rectifying unit can be provided in an upper part of the tank equipped with a guide plate in a shape of a cone that guides a vapor-liquid two phase flow rectified by the rectifying unit to the outlet.

The steam generator, according to a first aspect of the invention, provided with a tank that includes an inlet for feeding a fluid formed to a lower part and an outlet for discharging a vapor-liquid two phase flow formed on an upper part; and inside the tank, provided with a heating unit that produces a vapor-liquid two phase flow by heating the fed fluid, and a rectifying unit that homogenizes a vapor-liquid distribution in the vapor-liquid two phase flow in the tank. Accordingly, when a fluid is fed into the tank from the inlet, the fluid is heated by the heating unit, and then a vapor-liquid two phase flow containing bubbles is produced, and is to be discharged from the outlet after the vapor-liquid distribution in the vapor-liquid two phase flow is homogenized by the rectifying unit, so that a flow of the vapor-liquid two phase flow does not fluctuate at the outlet, and highly-precise control of the discharge flow can be achieved.

In the steam generator according to a second aspect of the invention, the rectifying unit is a porous cylindrical member provided as projected from the outlet into the inside of the tank. Accordingly, when the vapor-liquid two phase flow produced in the tank passes through pores of the cylindrical member, the sizes of contained bubbles are equalized, so that fluctuations in a flow of the vapor-liquid two phase flow at the outlet can be suppressed.

In the steam generator according to a third aspect of the invention, the rectifying unit is an orifice provided in the outlet. Accordingly, when the vapor-liquid two phase flow produced in the tank passes through the orifice, the pressure of the vapor-liquid two phase flow changes; consequently, the distribution of contained bubbles is homogenized; so that fluctuations in a flow of the vapor-liquid two phase flow at the outlet can be suppressed.

In the steam generator according to a fourth aspect of the invention, the rectifying unit is a porous rectification plate provided in an upper part of the tank. Accordingly, when the vapor-liquid two phase flow produced in the tank passes through pores of the rectification plate, the sizes of contained bubbles are equalized, so that fluctuations in a flow of the vapor-liquid two phase flow at the outlet can be suppressed.

In the steam generator according to a fifth aspect of the invention, the rectifying unit is a plurality of balls sandwiched between a pair of fixing plates provided in the upper part of the tank. Accordingly, when the vapor-liquid two phase flow produced in the tank passes through spaces between balls, the sizes of contained bubbles are equalized, so that fluctuations in a flow of the vapor-liquid two phase flow at the outlet can be suppressed.

In the steam generator according to a sixth aspect of the invention, the rectifying unit is constructed of a first rectifying unit provided in the upper part of the tank, and a second rectifying unit provided to the outlet. Accordingly, the vapor-liquid two phase flow produced in the tank is homogenized stepwise by two of the rectifying units, so that fluctuations in a flow of the vapor-liquid two phase flow at the outlet can be suppressed.

In the steam generator according to a seventh aspect of the invention, the first rectifying unit is constructed of an orifice, and the second rectifying unit is constructed of a porous cylindrical member provided as projected from the outlet into the inside of the tank, or a porous rectification plate, or a plurality of balls sandwiched between a pair of fixing plates. Accordingly, when the vapor-liquid two phase flow produced in the tank passes through the orifice, the pressure of the vapor-liquid two phase flow changes, and then the distribution of contained bubbles is homogenized; and in the next step, when passing through pores of the cylindrical member, the sizes of the contained bubbles are equalized, so that fluctuations in a flow of the vapor-liquid two phase flow at the outlet can be securely suppressed.

In the steam generator according to an eighth aspect of the invention, the first rectifying unit is constructed of a porous cylindrical member provided as projected from the outlet into the inside of the tank; the second rectifying unit is constructed of a porous rectification member; and pore dimensions in the second rectifying unit are set smaller than those in the first rectifying unit. Accordingly, bubbles contained in the vapor-liquid two phase flow produced in the tank are equalized in size when passing through smaller pores of the cylindrical member, and then the sizes of the contained bubbles are again equalized when passing through larger pores of the rectification member, so that equalizing the bubbles into a smaller size in advance can ensure that fluctuations in a flow of the vapor-liquid two phase flow at the outlet are suppressed.

In the steam generator according to a ninth aspect of the invention, the rectifying unit is provided in the upper part of the tank, and equipped with a guide plate in the shape of a cone that guides a vapor-liquid two phase flow rectified by the rectifying unit to the outlet. Accordingly, the vapor-liquid two phase flow produced in the tank is to be discharged by the guide plate guiding to the outlet after being homogenized by the rectifying unit, so that secure discharging of the vapor-liquid two phase flow in a homogenized state from the outlet can ensure that fluctuations in a flow of the vapor-liquid two phase flow are suppressed.

DETAILED DESCRIPTION OF THE INVENTION

Exemplary embodiments of a steam generator according to the present invention will be explained below in detail with reference to the accompanying drawings. However, the present invention is not limited to the embodiments.

First Embodiment

Figure 1:
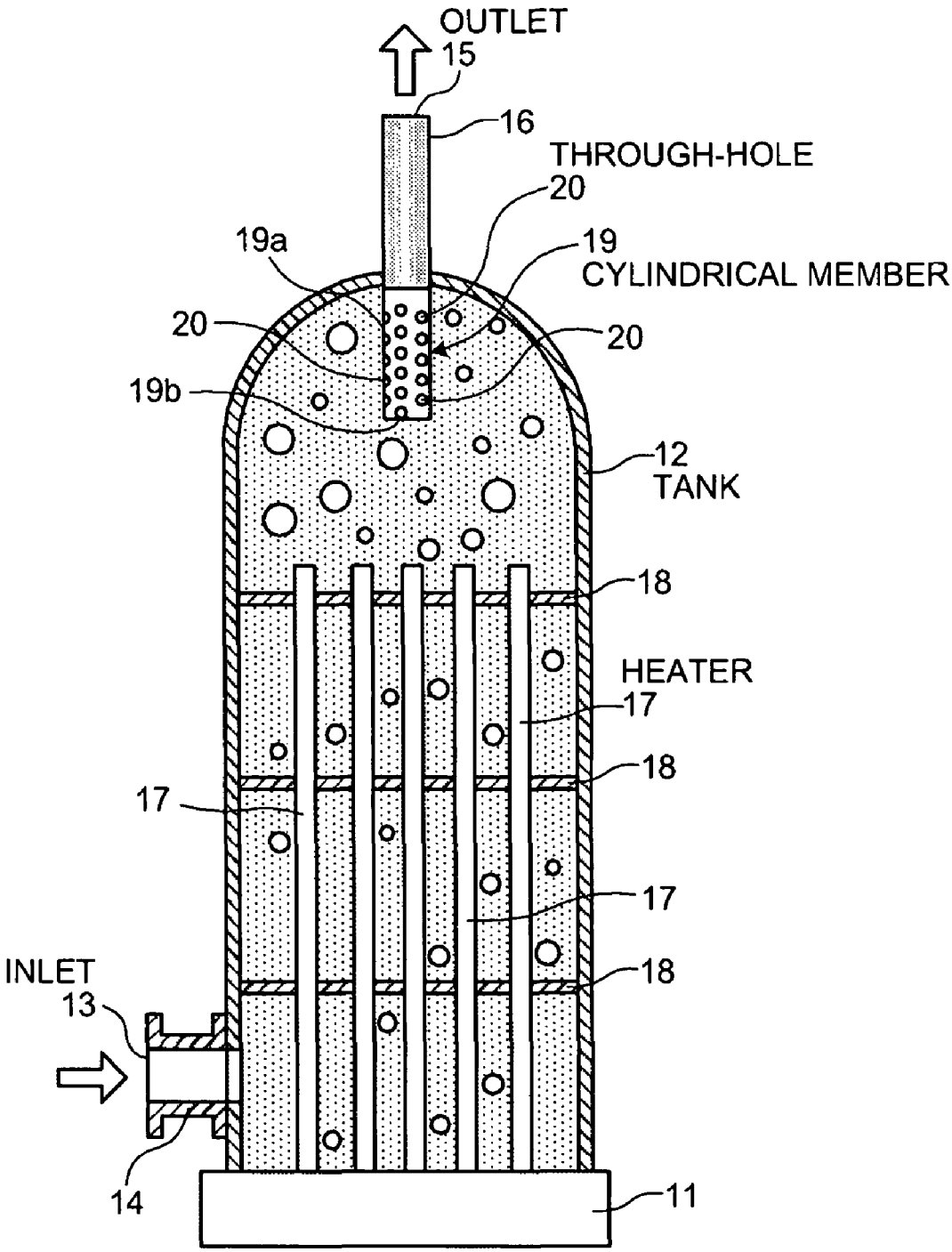
FIG. 1 is a vertical cross-section of a steam generator according to a first embodiment of the present invention.

FIG. 1 is a vertical cross-section of a steam generator according to a first embodiment of the present invention.

In the steam generator according to the first embodiment, as shown in FIG. 1, a tank 12 is anchored on a mount 11. The tank 12 is a hollow cylinder with a spherical profile at the upper end. A feed pipe 14 is provided in the lower portion of the tank 12. The feed pipe 14 includes an inlet 13 for feeding water as a fluid. On the other hand, a discharge pipe 16 is provided at the apex of the tank 12. The discharge pipe 16 includes an outlet 15 for discharging a vapor-liquid two phase flow produced inside the tank 12 to the outside. Moreover, a plurality of heaters 17 is provided inside the tank 12 in upright manner. Specifically, the mount 11 supports bottom ends of the heaters 17 while a plurality of support plates 18 supports the rest of the body of the heaters 17. The heaters 17 serve as a heating unit for heating the water fed into the tank 12 thereby producing vapor-liquid two phase flow. Although not shown in the figure, a number of communicating holes are formed in each of the support plates 18 so that fluid can flow up and down.

A rectifying unit is arranged in the tank 12. The rectifying unit homogenizes a vapor-liquid distribution in the vapor-liquid two phase flow produced in the tank 12. The homogenized vapor-liquid two phase flow is then discharged from the outlet 15. The rectifying unit has a configuration as follows. That is, the lower end of the discharge pipe 16 is coupled with a cylindrical member 19 that projects downward in the tank 12. The cylindrical member 19 includes a side surface 19*a* and a bottom surface 19*b*, and the upper end of the cylindrical member 19 communicates with the outlet 15 of the discharge pipe 16. A number of through-holes 20 that have the same diameter are formed on the side surface 19*a* and the bottom surface 19*b*.

When water is fed into the tank 12 from the inlet 13 by a not-shown feed pump, that water is heated by the heaters 17. Because of the heating, a number of bubbles are generated thereby producing a vapor-liquid two phase flow, which is hot water containing mixed steam. The vapor-liquid two phase flow containing the bubbles then ascends inside the tank 12 towards the outlet 15, and outflows from the outlet 15 through each of the through-holes 20 of the cylindrical member 19.

The bubbles generated inside the tank 12 vary in size and amount. Moreover, the bubbles tend to accumulate in the upper part of the tank 12, and coalesce into large bubbles, thereby forming gas pockets. Consequently, such large bubbles intermittently outflow from the outlet 15, so that fluctuations in the amount of bubbles in the vapor-liquid two phase flow generates vibrations, and the flow of the vapor-liquid two phase flow is disturbed.

To take care of this issue, according to the first embodiment, the cylindrical member 19 having the through-holes 20 is provided near the entrance of the outlet 15 from the tank 12. Even if the bubbles are built up in the upper part of the tank 12, the size and the amount of the built-up bubbles to be passed are regulated by each of the through-holes 20 of the cylindrical member 19, so that large bubbles in the tank 12 do not outflow intermittently from the outlet 15. For this reason, when the vapor-liquid two phase flow produced inside the tank 12 passes through each of the through-holes 20 of the cylindrical member 19, the bubble sizes are equalized, so that disturbance in the flow of the vapor-liquid two phase flow at the outlet 15 can be suppressed.

Thus, the steam generator according to the first embodiment is provided with the cylindrical member 19 that includes the through-holes 20 as a rectifying unit that homogenizes the vapor-liquid distribution in the vapor-liquid two phase flow.

Accordingly, the vapor-liquid distribution in the vapor-liquid two phase flow in the tank 12 is homogenized by the cylindrical member 19 that includes a number of the through-holes 20, and then the vapor-liquid two phase flow is discharged from the outlet 15. As a result, the flow of the vapor-liquid two phase flow is not disturbed when flowing out from the outlet 15, and highly-precise control of the discharge flow can be achieved.

Concretely, the lower end of the discharge pipe 16 is coupled with the cylindrical member 19 that projects downwards in the tank 12, and a number of the through-holes 20 are formed on the side surface 19*a* and the bottom surface 19*b* of the cylindrical number 19. Accordingly, the vapor-liquid two phase flow produced in the tank 12 efficiently inflows into the outlet 15 from each of the through-holes 20 of the cylindrical member 19 projected into the tank 12; and when bubbles pass through each of the through-holes 20 of the cylindrical member 19, the bubble sizes are equalized; so that disturbance in the flow of the vapor-liquid two phase flow at the outlet 15 can be securely suppressed.

Second Embodiment

Figure 2:
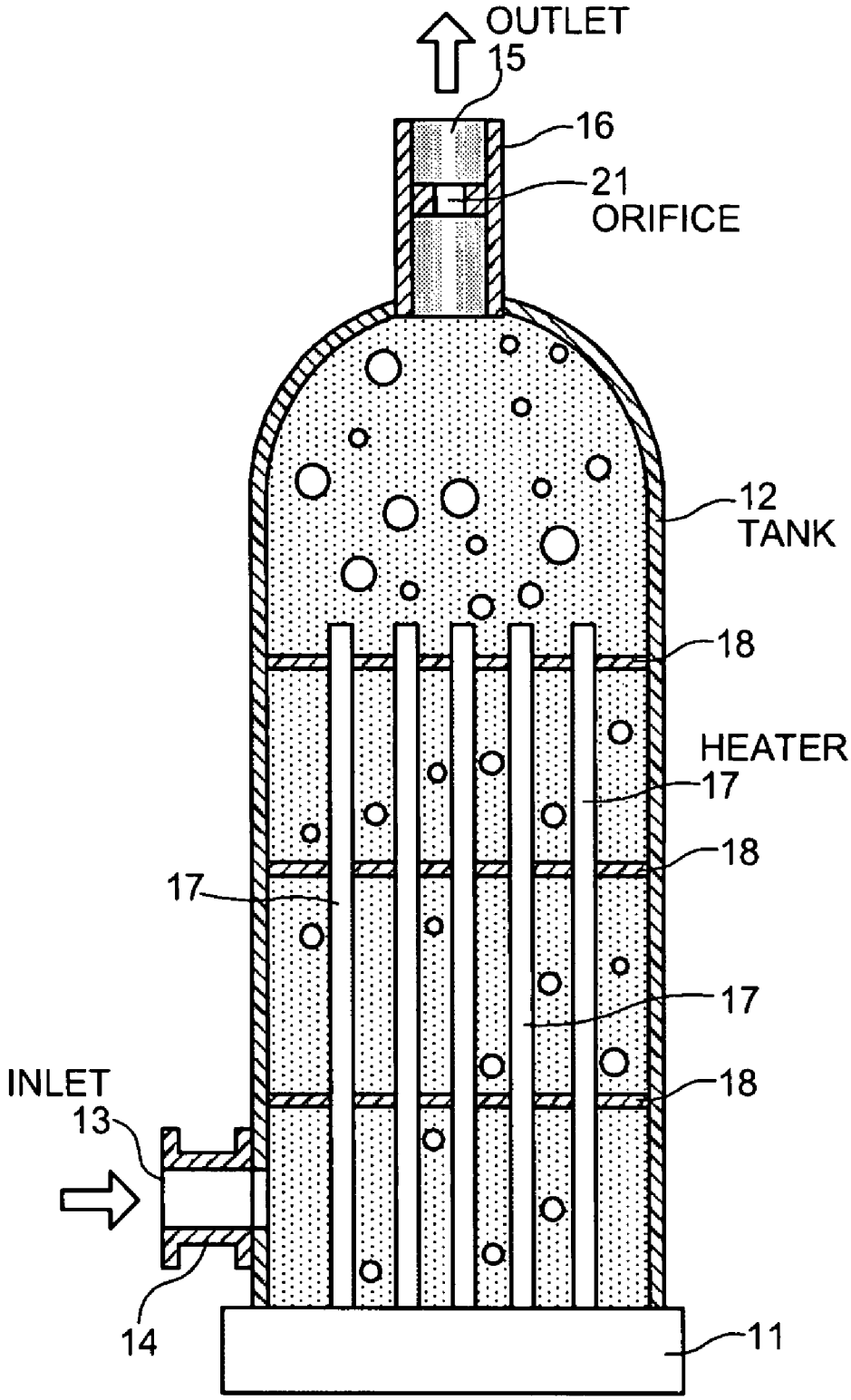
FIG. 2 is a vertical cross-section of a steam generator according to a second embodiment of the present invention.

FIG. 2 is a vertical cross-section of a steam generator according to a second embodiment of the present invention. Members that have functions similar to those explained in the embodiment described above are assigned with the same reference numerals, and the repetition of explanations of them is omitted.

In the steam generator according to the second embodiment, as shown in FIG. 2, the tank 12 is anchored on the mount 11. The feed pipe 14 having the inlet 13 is provided in the lower portion of the tank 12. On the other hand, the discharge pipe 16 with the outlet 15 is provided at the top end of the tank 12. The heaters 17 for heating water are provided inside the tank 12 in upright manner. Specifically, the mount 11 supports bottom ends of the heaters 17 while a plurality of support plates 18 supports the rest of the body of the heaters 17.

A rectifying unit is provided inside the outlet 15, which communicates with the tank 12. The rectifying unit homogenizes a vapor-liquid distribution in the vapor-liquid two phase flow produced in the tank 12. The homogenized vapor-liquid two phase flow is then discharged from the outlet 15. The rectifying unit has a configuration as follows. That is, an orifice 21 is provided at a halfway position in the discharge pipe 16, and the passage of the outlet 15 is made partially, narrow. When water is fed into the tank 12 from the inlet 13 by a not-shown feed pump, that water is heated by the heaters 17. Because of the heating, a number of bubbles are generated in the water thereby producing a vapor-liquid two phase flow, which is hot water containing mixed steam. The vapor-liquid two phase flow containing the bubbles then ascends inside the tank 12 towards the outlet 15, and outflows from the outlet 15 to the outside.

The bubbles generated inside the tank 12 vary in size and amount. Moreover, bubbles of various sizes tend to outflow through the outlet 15 intermittently, so that fluctuations in the amount of bubbles in the vapor-liquid two phase flow generate vibrations, and the flow of the vapor-liquid two phase flow is disturbed.

To take care of this issue, according to the second embodiment, the orifice 21 is provided inside the discharge pipe 16. When the vapor-liquid two phase flow containing bubbles of various sizes passes through the orifice 21, the flow resistance at the outlet 15 increases and a flow velocity increases. As a result, the flow of the vapor-liquid two phase flow upstream of the orifice 21, i.e., inside the tank 12, does not diffuse downstream due to the dumping effect. For this reason, in the downstream of the orifice 21, the vapor-liquid distribution in the vapor-liquid two phase flow is homogenized, so that disturbance in the flow of the vapor-liquid two phase flow at the outlet can be suppressed.

Thus, the steam generator according to the second embodiment is provided with the orifice 21 as a rectifying unit that homogenizes the vapor-liquid distribution in the vapor-liquid two phase flow.

Accordingly, the vapor-liquid two phase flow in the tank 12 is to be discharged from the outlet 15 after the vapor-liquid distribution in the vapor-liquid two phase flow is homogenized when passing through the orifice 21, so that the flow of the vapor-liquid two phase flow is not disturbed at the outlet 15, and highly-precise control of the discharge flow can be achieved. In addition, because the orifice 21 is employed as the rectifying unit, fluctuations in a flow of the vapor-liquid two phase flow can be securely suppressed by a simple configuration.

Third Embodiment

Figure 3:
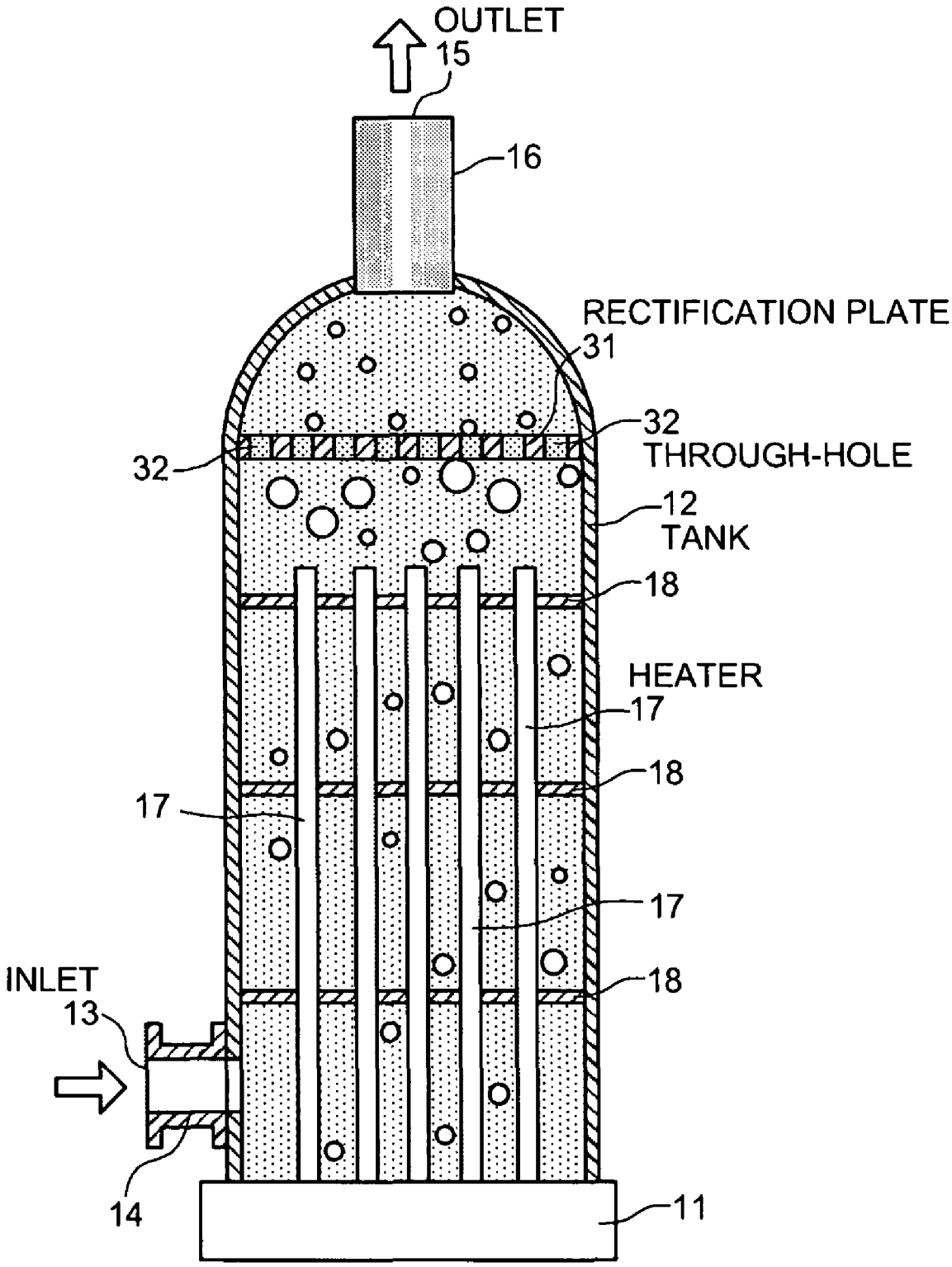
FIG. 3 is a vertical cross-section of a steam generator according to a third embodiment of the present invention.

FIG. 3 is a vertical cross-section of a steam generator according to a third embodiment of the present invention. Members that have functions similar to those explained in the embodiments described above are assigned with the same reference numerals, and the repetition of explanations of them is omitted.

In the steam generator according to the third embodiment, as shown in FIG. 3, the tank 12 is anchored on the mount 11. The feed pipe 14 having the inlet 13 is provided in the lower portion of the tank 12. On the other hand, the discharge pipe 16 with the outlet 15 is provided at the top end of the tank 12. The heaters 17 for heating water are provided inside the tank 12 in upright manner. Specifically, the mount 11 supports bottom ends of the heaters 17 while a plurality of support plates 18 supports the rest of the body of the heaters 17.

A rectifying unit is provided inside the tank 12. The rectifying unit homogenizes the vapor-liquid distribution in the vapor-liquid two phase flow produced in the tank 12. The homogenized vapor-liquid two phase flow is then discharged from the outlet 15. The rectifying unit has a configuration as follows. That is, in an upper part of the tank 12, which is between the heaters 17 and the outlet 15, a rectification plate 31 is secured horizontally. A number of through-holes 32 that have the same diameter are formed in the rectification plate 31.

When water is fed into the tank 12 from the inlet 13 by a not-shown feed pump, that water is heated by the heaters 17. Because of the heating, a number of bubbles are generated in the water thereby producing a vapor-liquid two phase flow, which is hot water containing mixed steam.

The vapor-liquid two phase flow containing the bubbles then ascends inside the tank 12 towards the outlet 15, and outflows from the outlet 15 through each of the through-holes 32 of the rectification plate 31.

The bubbles generated inside the tank 12 vary in size and amount; however, when the vapor-liquid two phase flow containing the bubbles passes through each of the through-holes 32 of the rectification plate 31, the bubbles are separated, and are equalized in size. Consequently, the vapor-liquid two phase flow in which the sizes of the bubbles are equalized passes through the rectification plate 31, further ascends, and then smoothly outflows from the outlet 15, so that disturbance in the flow of the vapor-liquid two phase flow at the outlet 15 can be suppressed.

Thus, the steam generator according to the third embodiment is provided with the rectification plate 31 having a number of the through-holes 32 as a rectifying unit that homogenizes the vapor-liquid distribution in the vapor-liquid two phase flow.

Accordingly, the vapor-liquid two phase flow produced in the tank 12 is to be discharged from the outlet 15 after the sizes of bubbles are equalized and also the vapor-liquid distribution in the vapor-liquid two phase flow is homogenized when passing through each of the through-holes 32 of the rectification plate 31, so that the flow of the vapor-liquid two phase flow is not disturbed at the outlet 15, and highly-precise control of the discharge flow can be achieved.

Fourth Embodiment

Figure 4:
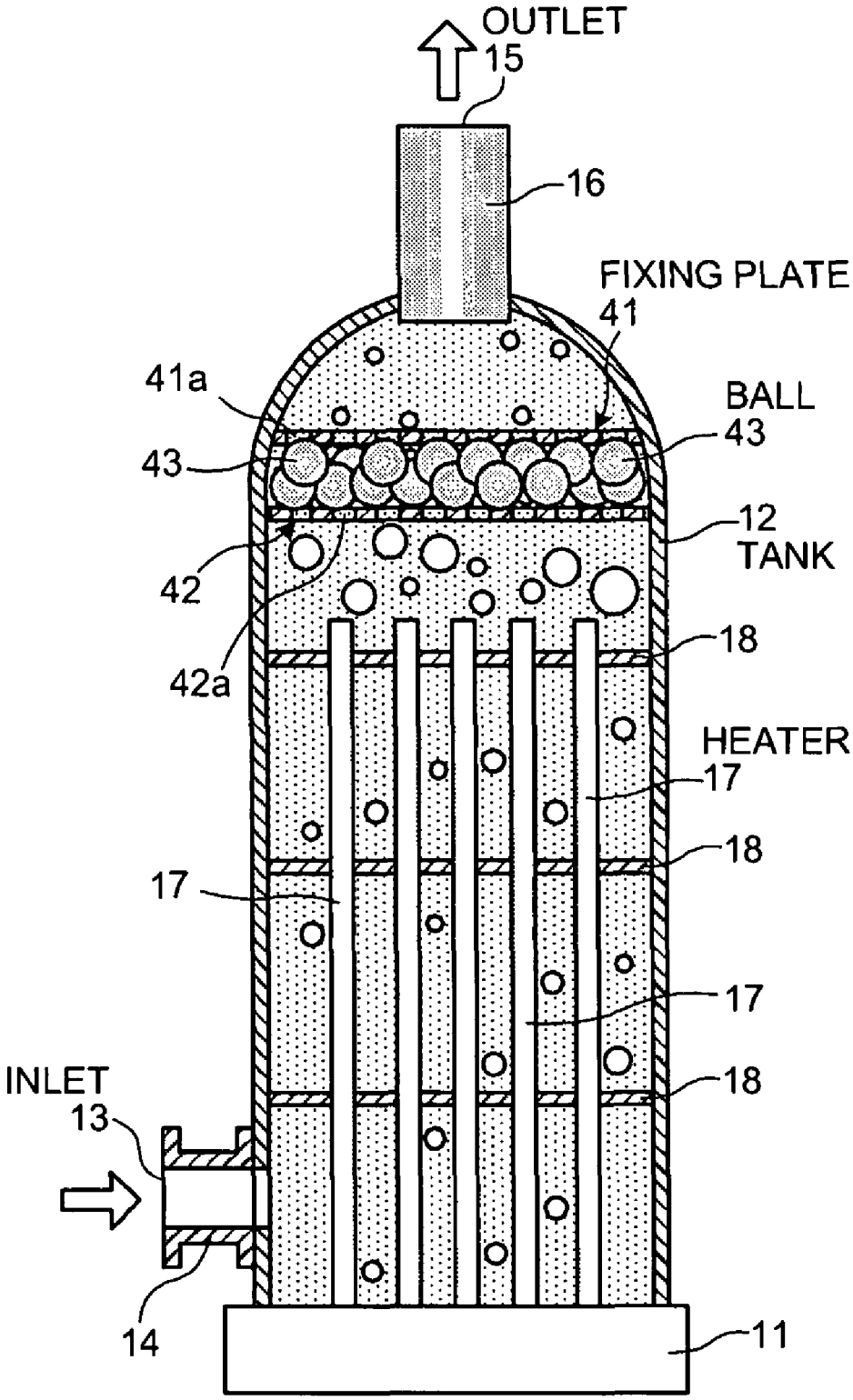
FIG. 4 is a vertical cross-section of a steam generator according to a fourth embodiment of the present invention.

FIG. 4 is a vertical cross-section of a steam generator according to a fourth embodiment of the present invention. Members that have functions similar to those explained in the embodiments described above are assigned with the same reference numerals, and the repetition of explanations of them is omitted.

In the steam generator according to the fourth embodiment, as shown in FIG. 4, the tank 12 is anchored on the mount 11. The feed pipe 14 having the inlet 13 is provided in the lower portion of the tank 12. On the other hand, the discharge pipe 16 with the outlet 15 is provided at the top end of the tank 12. The heaters 17 for heating water are provided inside the tank 12 in upright manner. Specifically, the mount 11 supports bottom ends of the heaters 17 while a plurality of support plates 18 supports the rest of the body of the heaters 17.

A rectifying unit is provided inside the tank 12. The rectifying unit homogenizes the vapor-liquid distribution in the vapor-liquid two phase flow produced in the tank 12. The homogenized vapor-liquid two phase flow is then discharged from the outlet 15. The rectifying unit has a configuration as follows. That is, in an upper part of the tank 12, which is between the heaters 17 and the outlet 15, a pair of fixing plates 41 and 42 is secured horizontally with a certain gap therebetween. Moreover, a plurality of balls 43 that has the same diameter are inserted in the gap between the pair of the fixing plates 41 and 42 in a sandwiched form, between which a plurality of communicating passages that has substantially the same diameter is formed. Through-holes 41*a* and 42*a* are formed in each of the fixing plates 41 and 42. The diameter of the through-holes 41*a* and 42*a* is smaller than the diameter of the balls 43, and larger than each of the communicating passages.

When water is fed into the tank 12 from the inlet 13 by a not-shown feed pump, that water is heated by the heaters 17. Because of the heating, a number of bubbles are generated in the water thereby producing a vapor-liquid two phase flow, which is hot water containing mixed steam. The vapor-liquid two phase flow containing the bubbles then ascends inside the tank 12 towards the outlet 15, and outflows from the outlet 15 through each of the communicating passages formed with the balls 43.

The bubbles generated inside the tank 12 vary in size and amount; however, when the vapor-liquid two phase flow containing the bubbles passes through the communicating passages between the balls 43, the bubbles are separated, and are equalized in size. Consequently, the vapor-liquid two phase flow in which the sizes of the bubbles are equalized passes through the communicating passages, further ascends, and then smoothly outflows from the outlet 15, so that disturbance in the flow of the vapor-liquid two phase flow at the outlet 15 can be suppressed.

Thus, the steam generator according to the fourth embodiment is provided with the communicating passages between the balls 43 sandwiched between the pair of fixing plates 41 and 42 as a rectifying unit that homogenizes the vapor-liquid distribution in the vapor-liquid two phase flow.

Accordingly, the vapor-liquid two phase flow produced in the tank 12 is to be discharged from the outlet 15 after the sizes of bubbles are equalized and also the vapor-liquid distribution in the vapor-liquid two phase flow is homogenized when passing through the communicating passages formed with the balls 43, so that the flow of the vapor-liquid two phase flow is not disturbed at the outlet 15, and highly-precise control of the discharge flow can be achieved.

Fifth Embodiment

Figure 5:
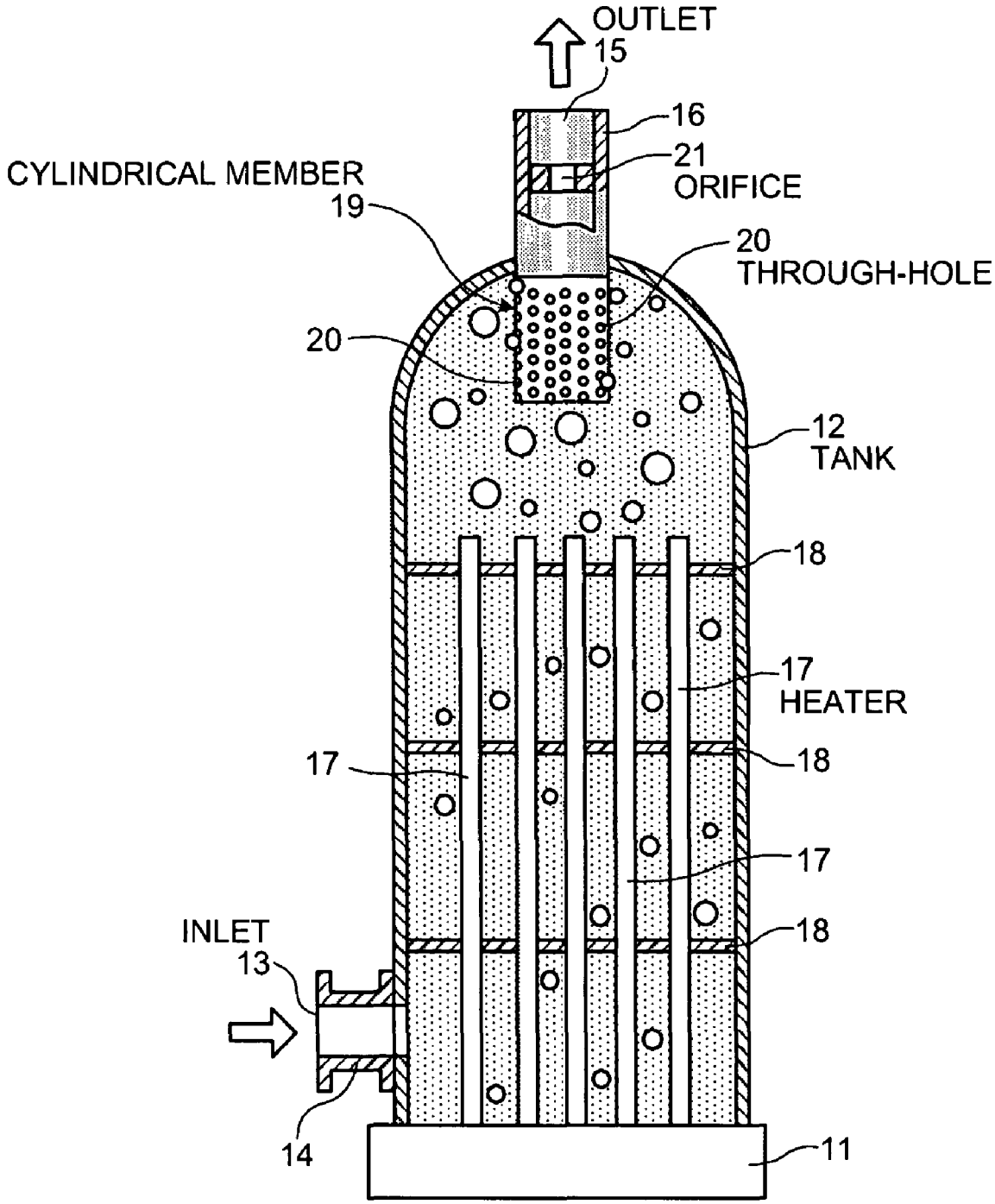
FIG. 5 is a vertical cross-section of a steam generator according to a fifth embodiment of the present invention.

FIG. 5 is a vertical cross-section of a steam generator according to a fifth embodiment of the present invention. Members that have functions similar to those explained in the embodiments described above are assigned with the same reference numerals, and the repetition of explanations of them is omitted.

In the steam generator according to the fifth embodiment, as shown in FIG. 5, the tank 12 is anchored on the mount 11. The feed pipe 14 having the inlet 13 is provided in the lower portion of the tank 12. On the other hand, the discharge pipe 16 with the outlet 15 is provided at the top end of the tank 12. The heaters 17 for heating water are provided inside the tank 12 in upright manner. Specifically, the mount 11 supports bottom ends of the heaters 17 while a plurality of support plates 18 supports the rest of the body of the heaters 17.

According to the fifth embodiment, two rectifying units are prepared for homogenizing the vapor-liquid distribution in the vapor-liquid two phase flow produced in the tank 12. As the first rectifying-unit, the orifice 21 is provided at a halfway position in the discharge pipe 16, and the passage of the outlet 15 is made partially narrow. Moreover, as the second rectifying unit, the cylindrical member 19 on which a number of the through-holes 20 are formed is provided at the lower end of the discharge pipe 16 that projects downward in the tank 12.

When water is fed into the tank 12 from the inlet 13 by a not-shown feed pump, that water is heated by the heaters 17. Because of the heating, a number of bubbles are generated in the water thereby producing a vapor-liquid two phase flow, which is hot water containing mixed steam. The vapor-liquid two phase flow containing the bubbles then ascends inside the tank 12 towards the outlet 15, and outflows from the outlet 15 to the outside.

The bubbles generated inside the tank 12 vary in size and amount. Moreover, the bubbles tend to accumulate in the upper part of the tank 12. However, when the bubbles pass through the through-holes 20 of the cylindrical member 19, the sizes and the amount of the bubbles are regulated, and the bubble sizes are equalized. Furthermore, when the vapor-liquid two phase flow in which the bubble sizes are equalized ascends and inflows into the outlet 15, a flow resistance of the vapor-liquid two phase flow containing the bubbles at the outlet 15 increases when passing through the orifice 21, and then a flow velocity increases, so that the vapor-liquid distribution in the vapor-liquid two phase flow is homogenized due to the dumping effect. As a result, disturbance in the flow of the vapor-liquid two phase flow at the outlet 15 can be securely suppressed.

Thus, the steam generator according to the fifth embodiment is provided with the cylindrical member 19 that includes the through-holes 20 and the orifice 21 as rectifying units that homogenize the vapor-liquid distribution in the vapor-liquid two phase flow.

Accordingly, when the vapor-liquid two phase flow in the tank 12 passes through each of the through-holes 20 of the cylindrical member 19, the bubble sizes are equalized; and when the vapor-liquid two phase flow passes through the orifice 21, the vapor-liquid distribution is homogenized; as a result, disturbance in the flow of the vapor-liquid two phase flow at the outlet 15 are suppressed, so that highly-precise control of the discharge flow can be achieved.

Although the cylindrical member 19 that includes the through-holes 20 is used as the second rectifying unit in the fifth embodiment, the second rectifying unit is not limited to this. In other words, the rectification plate 31 that includes a number of the through-holes 32 explained in the third embodiment described above, or the balls 43 sandwiched between the pair of fixing plates 41 and 42 explained in the fourth embodiment can be used as the second rectifying unit.

Sixth Embodiment

Figure 6:
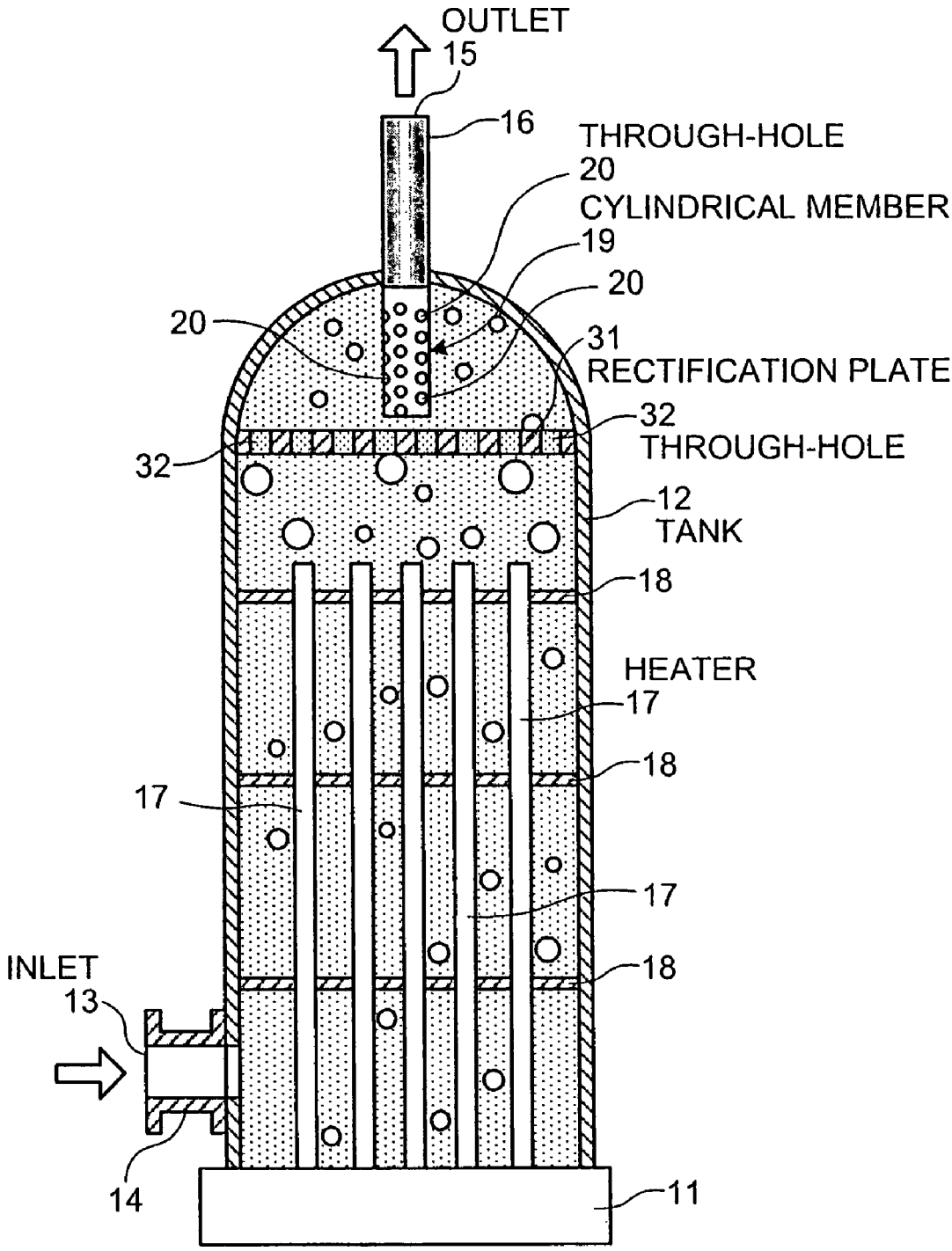
FIG. 6 is a vertical cross-section of a steam generator according to a sixth embodiment of the present invention.

FIG. 6 is a vertical cross-section of a steam generator according to a sixth embodiment of the present invention. Members that have functions similar to those explained in the embodiments described above are assigned with the same reference numerals, and the repetition of explanations of them is omitted.

In the steam generator according to the sixth embodiment, as shown in FIG. 6, the tank 12 is anchored on the mount 11. The feed pipe 14 having the inlet 13 is provided in the lower portion of the tank 12. On the other hand, the discharge pipe 16 with the outlet 15 is provided at the top end of the tank 12. The heaters 17 for heating water are provided inside the tank 12 in upright manner. Specifically, the mount 11 supports bottom ends of the heaters 17 while a plurality of support plates 18 supports the rest of the body of the heaters 17.

According to the sixth embodiment, two rectifying units are prepared for homogenizing the vapor-liquid distribution in the vapor-liquid two phase flow produced in the tank 12. As the first rectifying unit, the cylindrical member 19 on which a number of the through-holes 20 are formed is provided at the lower end of the discharge pipe 16 that projects downward in the tank 12. Moreover, as the second rectifying unit, the rectification plate 31 on which a number of the through-holes 32 are formed is secured in an upper part of the tank 12. The pore dimensions of each of the through-holes 32 on the rectification plate 31 are set smaller than those of each of the through-holes 20 on the cylindrical member 19.

When water is fed into the tank 12 from the inlet 13 by a not-shown feed pump, that water is heated by the heaters 17. Because of the heating, a number of bubbles are generated in the water thereby producing the vapor-liquid two phase flow, which is hot water containing mixed steam. The vapor-liquid two phase flow containing the bubbles then ascends inside the tank 12 towards the outlet 15, and outflows from the outlet 15 to the outside.

The bubbles generated inside the tank 12 vary in size and amount; however, when the vapor-liquid two phase flow containing the bubbles passes through each of the through-holes 32 of the rectification plate 31, the bubbles are separated, and are equalized in size. Furthermore, the bubbles of the vapor-liquid two phase flow may build up in the upper part of the tank 12; however, when the bubbles pass through each of the through-holes 20 of the cylindrical member 19, the sizes and the amount of the bubbles are regulated, and the bubble sizes are again equalized. As a result, disturbance in the flow of the vapor-liquid two phase flow at the outlet can be securely suppressed.

Thus, the steam generator according to the sixth embodiment is provided with the cylindrical member 19 that includes the through-holes 20 and the rectification plate 31 that includes the through-holes 32 as rectifying units for homogenizing the vapor-liquid distribution in the vapor-liquid two phase flow. Moreover, the pore dimensions of the through-holes 32 on the rectification plate 31 is smaller than those of the through-holes 20 on the cylindrical member 19.

Accordingly, when the vapor-liquid two phase flow in the tank 12 passes through each of the through-holes 32 of the rectification plate 31, the bubble sizes are equalized; and when the vapor-liquid two phase flow passes through each of the through-holes 20 of the cylindrical member 19, the bubble sizes are also equalized; furthermore, the pore dimensions of each of the through-holes 32 positioned upstream are set smaller than those of each of the through-holes 20 positioned downstream; as a result, while preventing pressure loss in the cylindrical member 19 of which passage dimensions are narrow, fluctuations in a flow of the vapor-liquid two phase flow at the outlet 15 are securely suppressed, so that highly-precise control of the discharge flow can be achieved.

Seventh Embodiment

Figure 7:
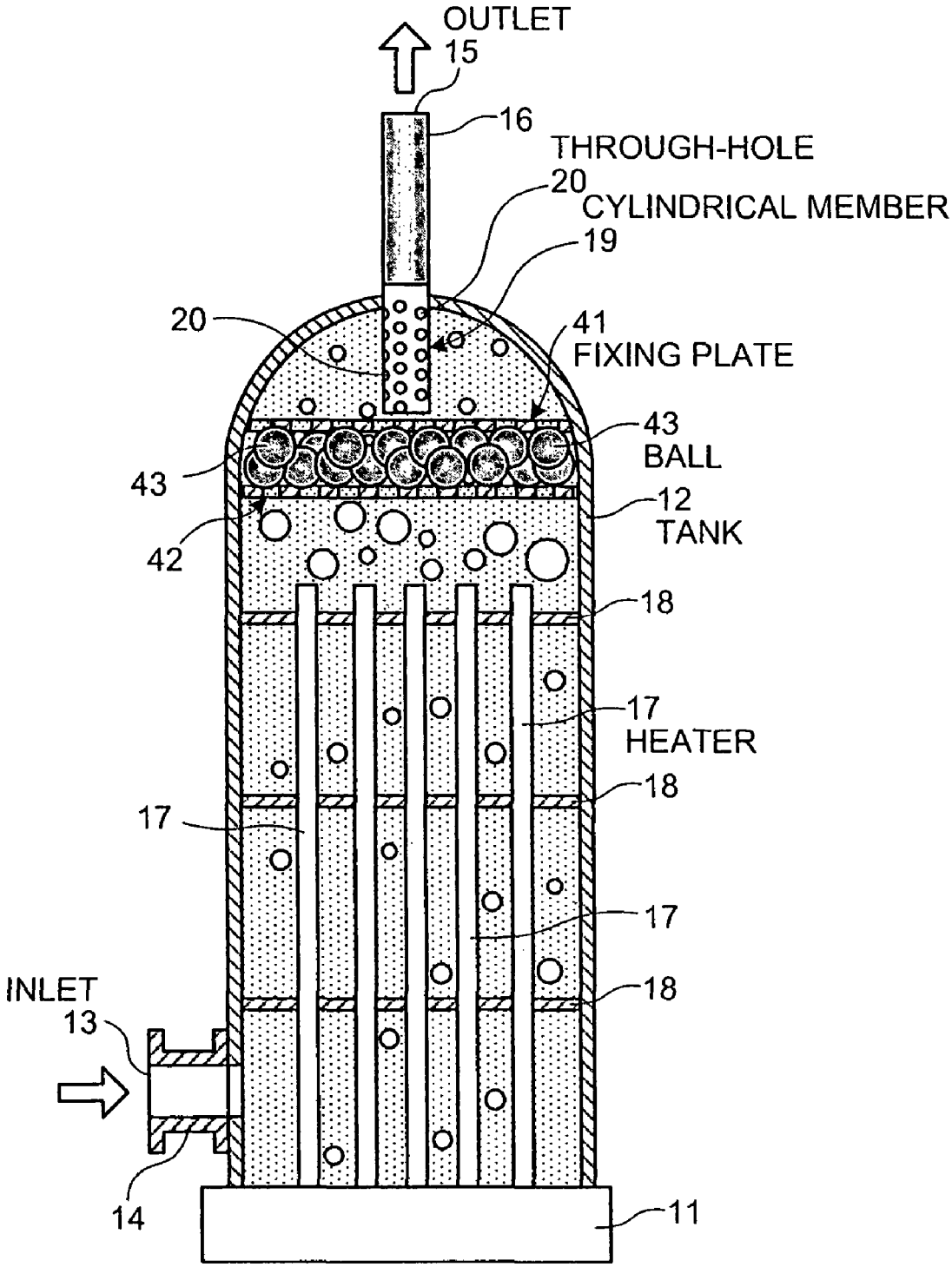
FIG. 7 is a vertical cross-section of a steam generator according to a seventh embodiment of the present invention.

FIG. 7 is a vertical cross-section of a steam generator according to a seventh embodiment of the present invention. Members that have functions similar to those explained in the embodiments described above are assigned with the same reference numerals, and the repetition of explanations of them is omitted.

In the steam generator according to the seventh embodiment, as shown in FIG. 7, the tank 12 is anchored on the mount 11. The feed pipe 14 having the inlet 13 is provided in the lower portion of the tank 12. On the other hand, the discharge pipe 16 with the outlet 15 is provided at the top end of the tank 12. The heaters 17 for heating water are provided inside the tank 12 in upright manner. Specifically, the mount 11 supports bottom ends of the heaters 17 while a plurality of support plates 18 supports the rest of the body of the heaters 17.

According to the seventh embodiment, two sets of rectifying units for homogenizing the vapor-liquid distribution in the vapor-liquid two phase flow produced in the tank 12 are provided. As a first rectifying unit, the cylindrical member 19 on which a number of the through-holes 20 are formed is provided at the lower end of the discharge pipe 16 that projects downward in the tank 12. Additionally, as a second rectifying unit, a plurality of communicating passages formed with the balls 43 sandwiched between the pair of the fixing plates 41 and 42 is provided in an upper part of the tank 12.

When water is fed into the tank 12 from the inlet 13 by a not-shown feed pump, that water is heated by the heaters 17. Because of the heating, a number of bubbles are generated in the water thereby producing the vapor-liquid two phase flow, which is hot water containing mixed steam. The vapor-liquid two phase flow containing the bubbles then ascends inside the tank 12 towards the outlet 15, and outflows from the outlet 15 to the outside.

The bubbles generated inside the tank 12 vary in size and amount; however, when the vapor-liquid two phase flow containing the bubbles passes through each of the communicating passages formed with the balls 43, the bubbles are separated, and are equalized in size. Furthermore, the bubbles of the vapor-liquid two phase flow may build up in the upper part of the tank 12; however, when the bubbles pass through each of the through-holes 20 of the cylindrical member 19, the sizes and the amount of the bubbles are regulated, and the bubble sizes are again equalized. As a result, disturbance in the flow of the vapor-liquid two phase flow at the outlet can be securely suppressed.

Thus, the steam generator according to the seventh embodiment is provided with the cylindrical member 19 that includes the through-holes 20 and the balls 43 sandwiched between the fixing plates 41 and 42 to form the communicating passages as rectifying units that homogenize the vapor-liquid distribution in the vapor-liquid two phase flow.

Accordingly, when the vapor-liquid two phase flow in the tank 12 passes through the communicating passages formed with the balls 43, the bubble sizes are equalized; and additionally the sizes of bubbles are equalized when passing through each of the through-holes 20 of the cylindrical member 19; as a result, disturbance in a flow of the vapor-liquid two phase flow at the outlet 15 are securely suppressed, so that highly-precise control of the discharge flow can be achieved. It is also possible to prevent pressure loss in the cylindrical member 19 of which passage dimensions are narrow by setting the pore dimensions of each of the communicating passages positioned upstream smaller than those of each of the through-holes 20 positioned downstream.

Eighth Embodiment

Figure 8:
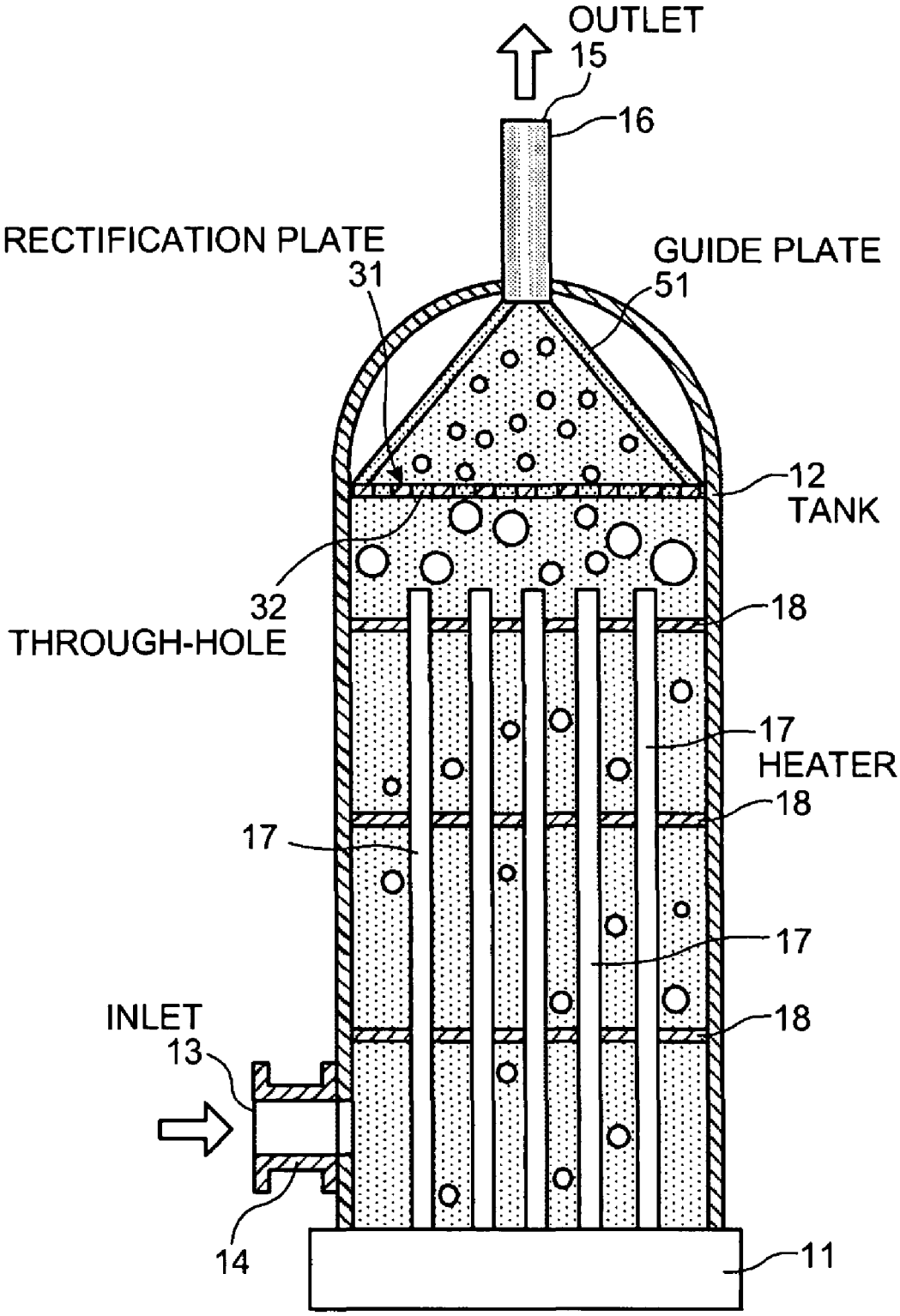
FIG. 8 is a vertical cross-section of a steam generator according to an eighth embodiment of the present invention.

FIG. 8 is a vertical cross-section of a steam generator according to an eighth embodiment of the present invention. Members that have functions similar to those explained in the embodiments described above are assigned with the same reference numerals, and the repetition of explanations of them is omitted.

In the steam generator according to the eighth embodiment, as shown in FIG. 8, the tank 12 is anchored on the mount 11. The feed pipe 14 is provided in the lower portion of the tank 12. The feed pipe 12 includes the inlet 13 is attached. On the other hand, the discharge pipe 16 is provided at the apex of the tank 12. The discharge pipe 16 includes the outlet 15. The heaters 17 for heating water are provided inside the tank 12 in upright manner. Specifically, the mount 11 supports bottom ends of the heaters 17 while a plurality of support plates 18 supports the rest of the body of the heaters 17.

As a rectifying unit that homogenizes the vapor-liquid distribution in the vapor-liquid two phase flow produced in the tank 12, the rectification plate 31 is secured in an upper part of the tank 12. A number of the through-holes 32 are formed in the rectification plate 31. Moreover, a guide plate 51 in the shape of a cone is secured between the rectification plate 31 and the outlet 15. The guide plate 51 is for guiding the vapor-liquid two phase flow rectified by the rectification plate 31 to the outlet 15 without building up in the upper end area of the tank 12.

When water is fed into the tank 12 from the inlet 13 by a not-shown feed pump, that water is heated by the heaters 17. Because of the heating, a number of bubbles are generated in the water thereby producing the vapor-liquid two phase flow, which is hot water containing mixed steam. The vapor-liquid two phase flow containing the bubbles then ascends inside the tank 12 towards the outlet 15, and outflows from the outlet 15 to the outside.

The bubbles generated inside the tank 12 vary in size and amount. However, when the vapor-liquid two phase flow containing the bubbles passes through each of the through-holes 32 of the rectification plate 31, the bubbles are separated, and are equalized in size. Consequently, the vapor-liquid two phase flow in which the sizes of the bubbles are equalized ascends along the guide plate 51, and then smoothly outflows from the outlet 15, so that disturbance in the flow of the vapor-liquid two phase flow at the outlet 15 can be suppressed.

Thus, the steam generator according to the eighth embodiment is provided with the guide plate 51 that guides the rectified vapor-liquid two phase flow to the outlet 15.

Accordingly, when the vapor-liquid two phase flow produced in the tank 12 passes through each of the through-holes 32 of the rectification plate 31, the sizes of bubbles are equalized; and then the equalized vapor-liquid two phase flow ascends along the guide plate 51 without convection, and is smoothly discharged from the outlet 15; so that a flow of the vapor-liquid two phase flow is not disturbed at the outlet 15, and highly-precise control of the discharge flow can be achieved.

Although the rectifying unit according to the present invention is constructed of the cylindrical member 19, the orifice 21, the rectification plate 31, and/or the balls 43 in the embodiments described above, the configuration is not limited to this, but also an ultrasonic generator can be provided in the tank 12 or the outlet 15, and the number of the rectifying units is not limited to one or two, but also three or more units can be provided.

The steam generator according to the present invention is configured to discharge a vapor-liquid two phase flow produced in the tank after homogenizing the vapor-liquid distribution in the vapor-liquid two phase flow, and can be applied to any kind of steam generator.

The invention claimed is:

1. A steam generator comprising:

a tank having an inlet in a lower part for feeding a fluid, and an outlet in an upper part for discharging a vapor-liquid two phase flow;

a heating unit that heats the fluid in the tank thereby producing the vapor-liquid two phase flow; and a rectifying unit that homogenizes vapor-liquid distribution in the vapor-liquid two phase flow before the vapor-liquid two phase flow is discharged from the outlet, wherein the rectifying unit includes a plurality of balls sandwiched between a pair of fixing plates arranged in the upper part of the tank.

2. The steam generator according to claim 1, wherein the plurality of balls sandwiched between a pair of fixing plates is a first rectifying unit, and a second rectifying unit is arranged inside the outlet.

3. The steam generator according to claim 2, wherein the second rectifying unit includes an orifice.

4. The steam generator according to claim 1, wherein the tank is equipped with a guide plate in a shape of a cone that guides the vapor-liquid two phase flow rectified by the rectifying unit to the outlet.

5. A steam generator comprising:

a tank having an inlet in a lower part for feeding a fluid, and an outlet in an upper part for discharging a vapor-liquid two phase flow;

a heating unit that heats the fluid in the tank thereby producing the vapor-liquid two phase flow; and a rectifying unit that homogenizes vapor-liquid distribution in the vapor-liquid two phase flow before the vapor-liquid two phase flow discharged from the outlet, wherein the rectifying unit includes a first rectifying unit arranged inside the outlet, and a second rectifying unit arranged in an upper part of the tank, and wherein the first rectifying unit includes a porous cylindrical member that projects from the outlet into an inside of the tank, the second rectifying unit includes a porous rectification member, and pores of the porous cylindrical member have smaller diameters than pores of the porous rectification member.

6. The steam generator according to claim 5, wherein the tank is equipped with a guide plate in a shape of a cone that guides the vapor-liquid two phase flow rectified by the rectifying unit to the outlet.

* * * * *